US010589285B2

(12) United States Patent
Anderson, Jr. et al.

(10) Patent No.: US 10,589,285 B2
(45) Date of Patent: Mar. 17, 2020

(54) FEEDER BREAKER WITH REDUCED FINES GENERATION

(71) Applicant: Joy MM Delaware, Inc., Wilmington, DE (US)

(72) Inventors: Charles M. Anderson, Jr., Paris, KY (US); Michael Nolan, Lexington, KY (US)

(73) Assignee: Joy Global Underground Mining LLC, Warrendale, PA (US)

( * ) Notice: Subject to any disclaimer, the term of this patent is extended or adjusted under 35 U.S.C. 154(b) by 176 days.

(21) Appl. No.: 15/645,140

(22) Filed: Jul. 10, 2017

(65) Prior Publication Data

US 2019/0009279 A1 Jan. 10, 2019

(51) Int. Cl.

| | |
|---|---|
| ***B02C 21/02*** | (2006.01) |
| ***E21F 13/00*** | (2006.01) |
| ***B02C 23/02*** | (2006.01) |

(52) U.S. Cl.

CPC ..... *B02C 21/02* (2013.01); *B02C 23/02* (2013.01); *E21F 13/002* (2013.01)

(58) Field of Classification Search

CPC ..... B02C 21/02; B02C 21/026; B02C 23/02; B02C 23/08; B02C 23/10; B02C 23/16; B02C 23/165; B02C 13/286; B02C 18/22

See application file for complete search history.

(56) References Cited

U.S. PATENT DOCUMENTS

| | | | | |
|---|---|---|---|---|
| 3,438,491 A | | 4/1969 | Haley et al. | |
| 3,647,150 A | | 3/1972 | Stephanek | |
| 4,418,872 A | | 12/1983 | Nelson | |
| 4,463,940 A | | 8/1984 | Mock | |
| 4,592,516 A | | 6/1986 | Tschantz | |
| 4,598,875 A | * | 7/1986 | Bronson | B02C 23/12 241/101.76 |
| 4,890,720 A | | 1/1990 | Brais | |
| 4,909,449 A | | 3/1990 | Etheridge | |

(Continued)

FOREIGN PATENT DOCUMENTS

| | | |
|---|---|---|
| AU | 2005202558 | 1/2006 |
| CA | 1132511 A | 9/1982 |

(Continued)

OTHER PUBLICATIONS

"Drag Chain Feeders & Feeder-Breaker", web page, 2016, 2 pages, McLanahan, http://mclanahan.com/products/drag- Chain-feeders-feeder-breakers/.

(Continued)

*Primary Examiner* — Matthew Katcoff

(74) *Attorney, Agent, or Firm* — Michael Best & Friedrich LLP

(57) ABSTRACT

A feeder breaker includes a frame, a first crusher coupled to the frame and configured to receive material, a second crusher coupled to the frame, a conveyor extending between the first crusher and the second crusher configured to convey material exiting the first crusher to the second crusher, and an output conveyor configured to receive the material exiting the second crusher. The feeder breaker is also configured to allow at least a portion of material exiting the first crusher that is below a predetermined size threshold to move to the output conveyor without passing through the second crusher.

19 Claims, 9 Drawing Sheets

(56) References Cited

U.S. PATENT DOCUMENTS

| | | | |
|---|---|---|---|
| 5,097,610 | A | 3/1992 | Bishop |
| 5,183,160 | A | 2/1993 | McCain |
| 5,255,869 | A | 10/1993 | Smith |
| 5,421,108 | A | 6/1995 | Stewart |
| 5,427,439 | A | 6/1995 | Herickhoff |
| 5,441,206 | A | 8/1995 | Schade et al. |
| 5,445,330 | A | 8/1995 | Shokry Rashwan et al. |
| 5,667,279 | A | 9/1997 | Christopher et al. |
| 5,694,709 | A | 12/1997 | Cronk, Jr. et al. |
| 5,881,959 | A | 3/1999 | Hadjinian et al. |
| 6,637,680 | B1 | 10/2003 | Young et al. |
| 6,752,339 | B2 | 6/2004 | Moriya et al. |
| 6,834,764 | B2 | 12/2004 | Krell et al. |
| 6,935,587 | B2 | 8/2005 | Brock et al. |
| 7,051,962 | B2 | 5/2006 | Whitsel et al. |
| 7,588,204 | B2 | 9/2009 | Douglas et al. |
| 8,162,245 | B2 | 4/2012 | Sauser et al. |
| 8,245,961 | B2 | 8/2012 | Vroom et al. |
| 8,434,706 | B2 | 5/2013 | Davis |
| 8,469,298 | B2 | 6/2013 | Robinson et al. |
| 8,770,373 | B2 | 7/2014 | Neilson et al. |
| 9,221,059 | B2 | 12/2015 | Blondin et al. |
| 2004/0094642 | A1 | 5/2004 | Everson |
| 2012/0007412 | A1 | 1/2012 | Zimmerman |
| 2013/0214585 | A1 | 8/2013 | Zimmerman et al. |
| 2014/0263777 | A1 | 9/2014 | Anderson, Jr. |
| 2014/0284409 | A1 | 9/2014 | Zimmerman et al. |
| 2014/0286738 | A1 | 9/2014 | Zimmerman et al. |
| 2016/0288134 | A1 | 10/2016 | Anderson, Jr. et al. |
| 2017/0341084 | A1 | 11/2017 | Brouwer et al. |

FOREIGN PATENT DOCUMENTS

| | | | |
|---|---|---|---|
| DE | 1941906 | U | 7/1966 |
| DE | 3503640 | | 8/1986 |
| DE | 3503640 | A1 | 8/1986 |
| EP | 1136130 | | 9/2001 |
| FR | 2924037 | | 5/2009 |
| FR | 2929536 | | 10/2009 |
| FR | 2924037 | B1 | 11/2009 |
| GB | 2186504 | | 8/1987 |
| JP | H11347493 | | 12/1999 |
| JP | 3778696 | B2 | 5/2006 |

OTHER PUBLICATIONS

GB1605286.2 Search Report from the United Kingdom Intellectual Property Office dated Jul. 22, 2016 (3 pages).

European Patent Office Search Report for Application No. 18182621.5-1018 dated Dec. 10, 2018 (7 pages).

* cited by examiner

FEEDER BREAKER WITH REDUCED FINES GENERATION

FIELD OF THE INVENTION

The present invention relates to underground mining equipment, in particular, a feeder breaker that reduces the amount of fines generated while maintaining a large crushing ratio.

BACKGROUND OF THE INVENTION

Feeder breakers are generally used in mining applications to appropriately size and sort a mine material. Typically, material passes through feeder breakers and is broken down (e.g., crushed) into a smaller size. However, the mine material may become too small (i.e., fines), which is generally considered as waste.

SUMMARY OF THE INVENTION

In one embodiment, the invention provides a feeder breaker including a frame, a first crusher coupled to the frame and configured to receive a material, and a second crusher coupled to the frame. The feeder breaker further includes a conveyor extending between the first crusher and the second crusher. The conveyor is configured to convey the material exiting the first crusher to the second crusher. The feeder breaker further includes an output conveyor configured to receive the material exiting the second crusher. At least a portion of the material exiting the first crusher that is below a predetermined size threshold moves to the output conveyor without passing through the second crusher.

In another embodiment, the invention provides a feeder breaker including a frame having a first end, a second end opposite the first end, and a material flow direction defined between the first end and the second end. The feeder breaker also includes a conveying assembly coupled to the frame and configured to convey a material in the material flow direction, a first crusher coupled to the frame and configured to receive the material conveyed by the conveying assembly, and a second crusher coupled to the frame downstream of the first crusher in the material flow direction. The second crusher is configured to receive the material conveyed by the conveying assembly. The feeder breaker further includes a flow limiting member coupled to the frame downstream of the first crusher in the material flow direction. The flow-limiting member is configured to limit a flow of the material to the second crusher.

Other aspects of the invention will become apparent by consideration of the detailed description and accompanying drawings.

Figure 1:
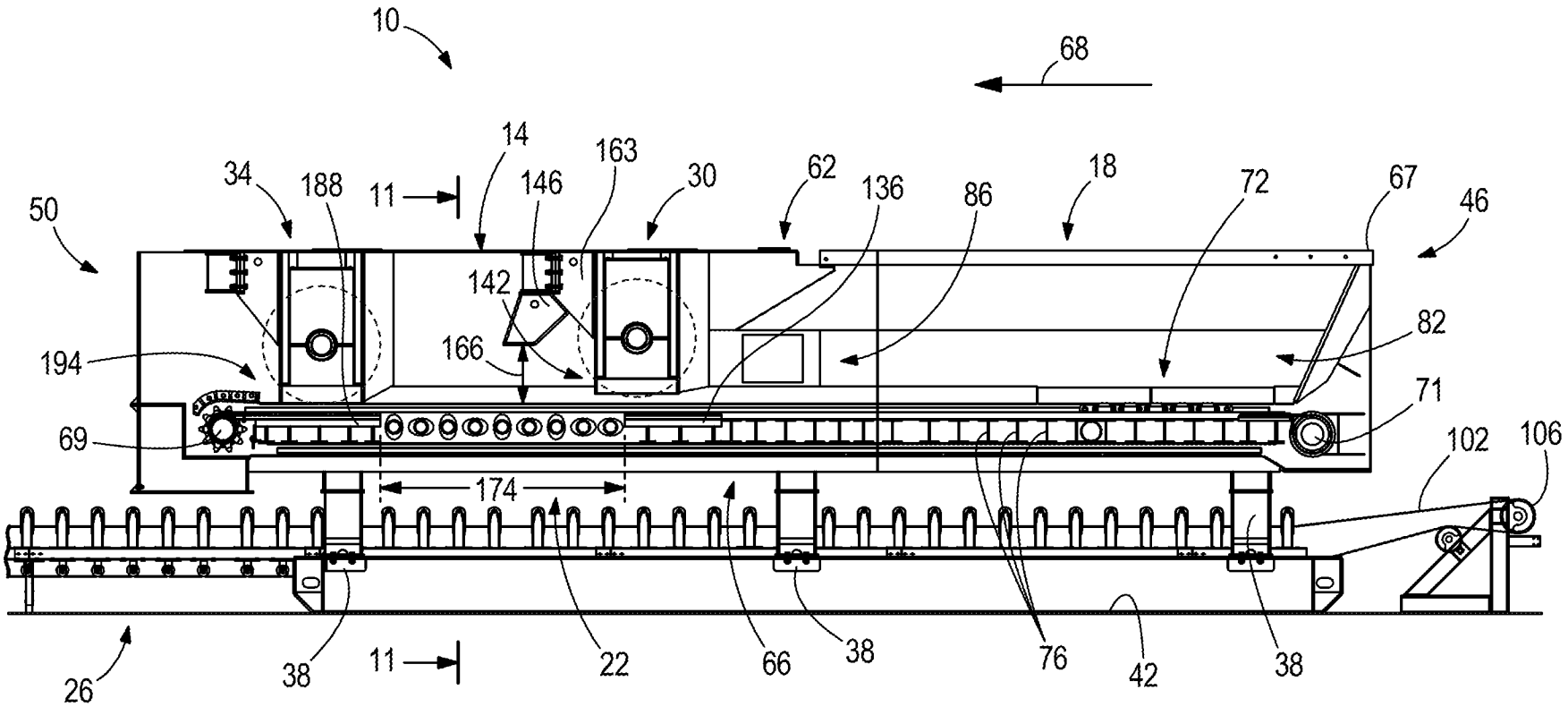
FIG. 1 is a side view of a feeder breaker with partial cross-section views shown according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. It should be understood that the description of specific embodiments is not intended to limit the disclosure from covering all modifications, equivalents, and alternatives falling within the spirit and scope of the disclosure. Also, it is to be understood that the phraseology used herein for the purpose of description and should not be regarded as limiting.

DETAILED DESCRIPTION

With reference to FIGS. 1-11, a feeder breaker 10 is illustrated according to an embodiment of the invention. The feeder breaker 10 includes a frame 14, an input conveying section 18, a screening conveying section 22, an output conveying assembly 26, a first crusher 30, and a second crusher 34. The frame 14 includes supports 38 that support the feeder breaker 10 on a mine floor 42. The frame 14 has an intake end 46, a discharge end 50, a first lateral side 54, a second lateral side 58 opposite the first lateral side 54, a top side 62, and a bottom side 66. Alternatively, the frame 14 includes crawlers, wheels, or other suitable mobile devices to allow mobility of the feeder breaker 10. Additionally, the frame 14 includes a hopper 67 configured to receive material (e.g., from a separate load, haul, dump (LHD) vehicle). In the illustrated embodiment, the hopper 67 is a 3-way dump hopper. In other words, the 3-way dump hopper allows material to be dumped in the hopper 67 from three different sides of the feeder breaker 10.

A material flow direction 68 is generally defined from the intake end 46 of the frame 14 to the discharge end 50 of the frame 14. The first crusher 30 and the second crusher 34 are coupled to the frame 14, with the first crusher 30 upstream in the material flow direction 68 from the second crusher 34. Both the first crusher 30 and the second crusher 34 are configured to receive a material (e.g., a mine material). The input conveying section 18 and the screening conveying section 22 are subsequent in the material floor direction 68 meaning mine material is conveyed from the input conveying section 18 to the screening conveying section 22 from the intake end 46 to the discharge end 50. A headshaft (drive shaft) 69 is located downstream of the second crusher 34 in the material flow direction 68 and is coupled to the frame. A tailshaft 71 is also coupled to the frame 14 upstream of the first crusher 30 approximate the intake end 46. The screening conveying section 22 is located between the first crusher 30 and the second crusher 34 to screen undersized material from the first crusher 34. The output conveying assembly 26 is positioned beneath the input conveying section 18 and the screening conveying section 22 and is configured to convey appropriately sized mine material.

With reference to FIGS. 3-7, a conveyor 72 conveys material from the intake end 46 to the discharge end 50 through both the input conveyor section 18 and the screening conveyor section 22. The conveyor 72 is coupled to the headshaft 69 and the tailshaft 71 and is configured to travel in a continuous loop (i.e., continuous conveyor). Travel of the conveyor 72 follows the continuous loop from the tailshaft 71 to the headshaft 69, over the headshaft 69, and back to the tailshaft. The conveyor 72 includes chains 74*a* and 74*b* (e.g., continuous chains) that are supported by wear strips 75*a*, 75*b* that extend in the material flow direction 68 between the headshaft 69 and the tailshaft 71. Beneath the wear strips 75*a*, 75*b* are beams 76 (e.g., I-beams) (FIG. 1) that extend from the first side 54 of the frame 14 to the second side 58 of the frame 14. The beams 76 are spaced apart to allow mine material under a predetermined size to pass through. The beams 76 are also positioned along the entire length of the frame 14 from the intake end 46 to the discharge end 50 except for between the first crusher 30 and the second crusher 34.

Additionally, the conveyor 72 includes a plurality of flights 77 that links the chains 74*a*, 74*b* together. The flights 77 are supported by slats 78 that extend in the material flow direction 68 from the headshaft 69 to the first crusher 30 and lay on top of the beams 76 between the wear strips 75*a*, 75*b*. In the illustrated embodiment, there are nine slats 78 each spaced apart from the other by approximately 100 mm. In other embodiments, the number of slats 78 can vary to accommodate mine material of different size to pass. Each of the chains 74*a*, 74*b* and flights 77 are moveable relative to the wear strips 75*a*, 75*b*, beams 76, and flights 77 by the headshaft 69. In particular, the headshaft 69 is coupled to a motor 79 and includes sprockets that each directly mesh with the chains 74*a*, 74*b*.

Figure 4:
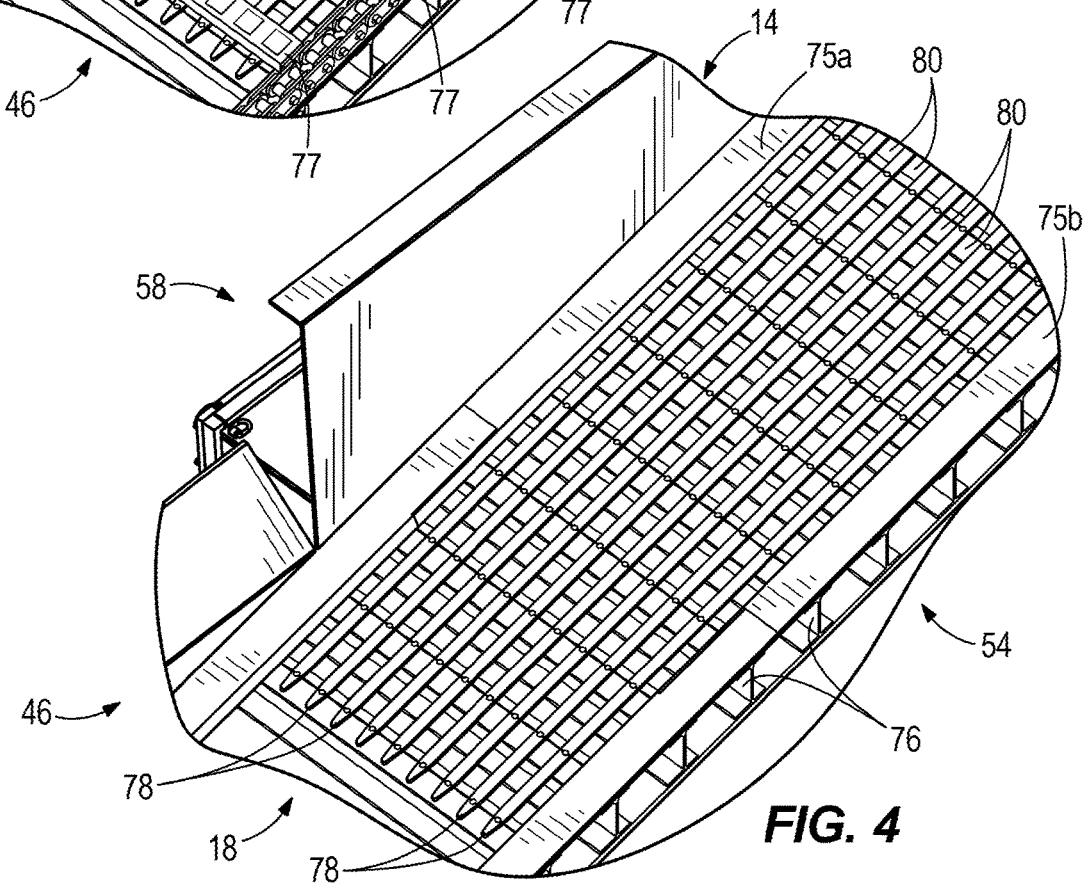
FIG. 4 is a partial perspective view of FIG. 3, with components removed for clarity.

With continued reference to FIGS. 3-7, a plurality of openings 80 are defined between the slats 78 and allow material smaller than a first predetermined size (i.e., smaller than the openings 80) to move through the beams 76 and onto the output conveying assembly 26 positioned below (FIG. 4). The openings 80 extend parallel to the material flow direction 68 of the conveyor 72. In other embodiments, the plurality of openings 80 may be any size to allow for a particular size of material to pass through the plurality of openings 80. The illustrated conveyor 72 is configured to allow communication between the slats 78 and openings 80 and the output conveying assembly 26 (FIG. 1) located below the conveyor 72.

With reference to FIGS. 1-4, the input conveying section 18 extends between the hopper 67 and the first crusher 30 and is configured to move material from the hopper 67 to the first crusher 30. In the illustrated embodiment, the conveyor 72 is parallel to the mine floor 42, but in alternative embodiments the input conveying section 18 is oriented at an inclined angle relative to the mine floor 42 from the hopper 67 towards the first crusher 30 to elevate material from the hopper 67 in order to accommodate output conveying assemblies 26 of different heights. Alternatively, the supports 38 of the frame 14 may individually be height adjustable to create an adjustable conveying angle with respect to the mine floor 42 (e.g., an inclined or declined conveying path for mine material). The input conveying section 18 includes an upstream end 82 positioned within the hopper 67, a downstream end 86 positioned adjacent the first crusher 30, and a shield plate 90, to cover the tailshaft 71.

Figure 10:
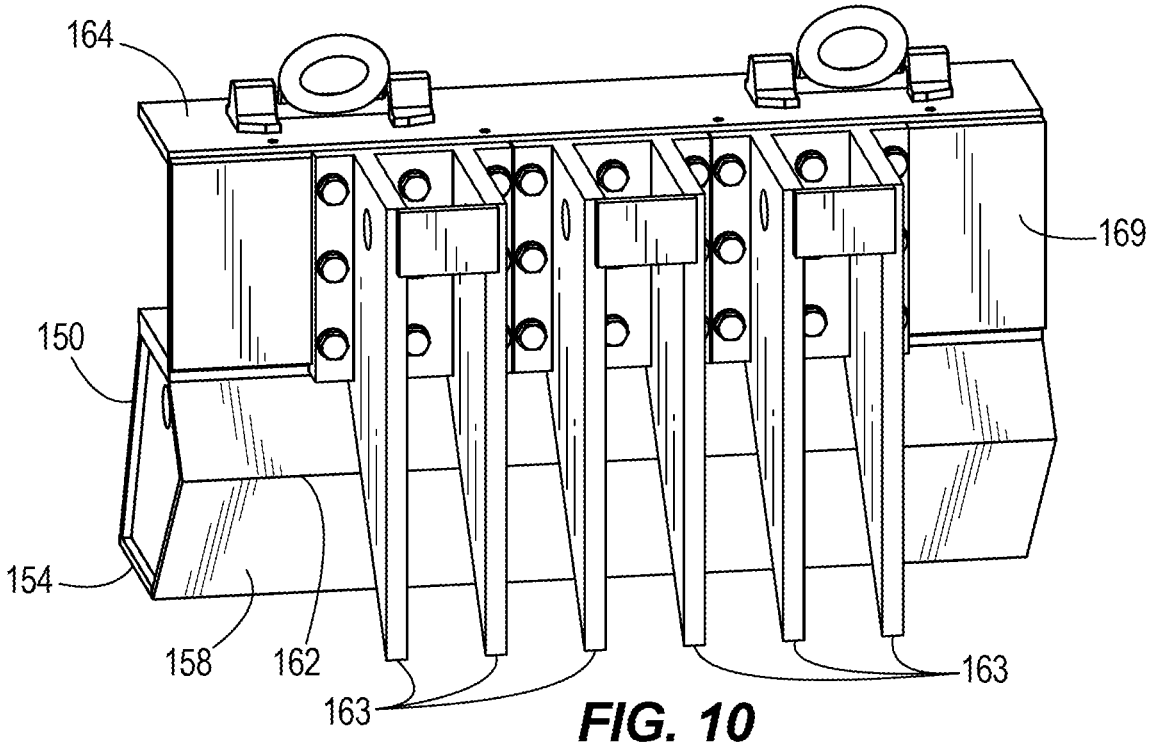
FIG. 10 is a perspective view of the flow limiting member of FIG. 6.
Figure 11:
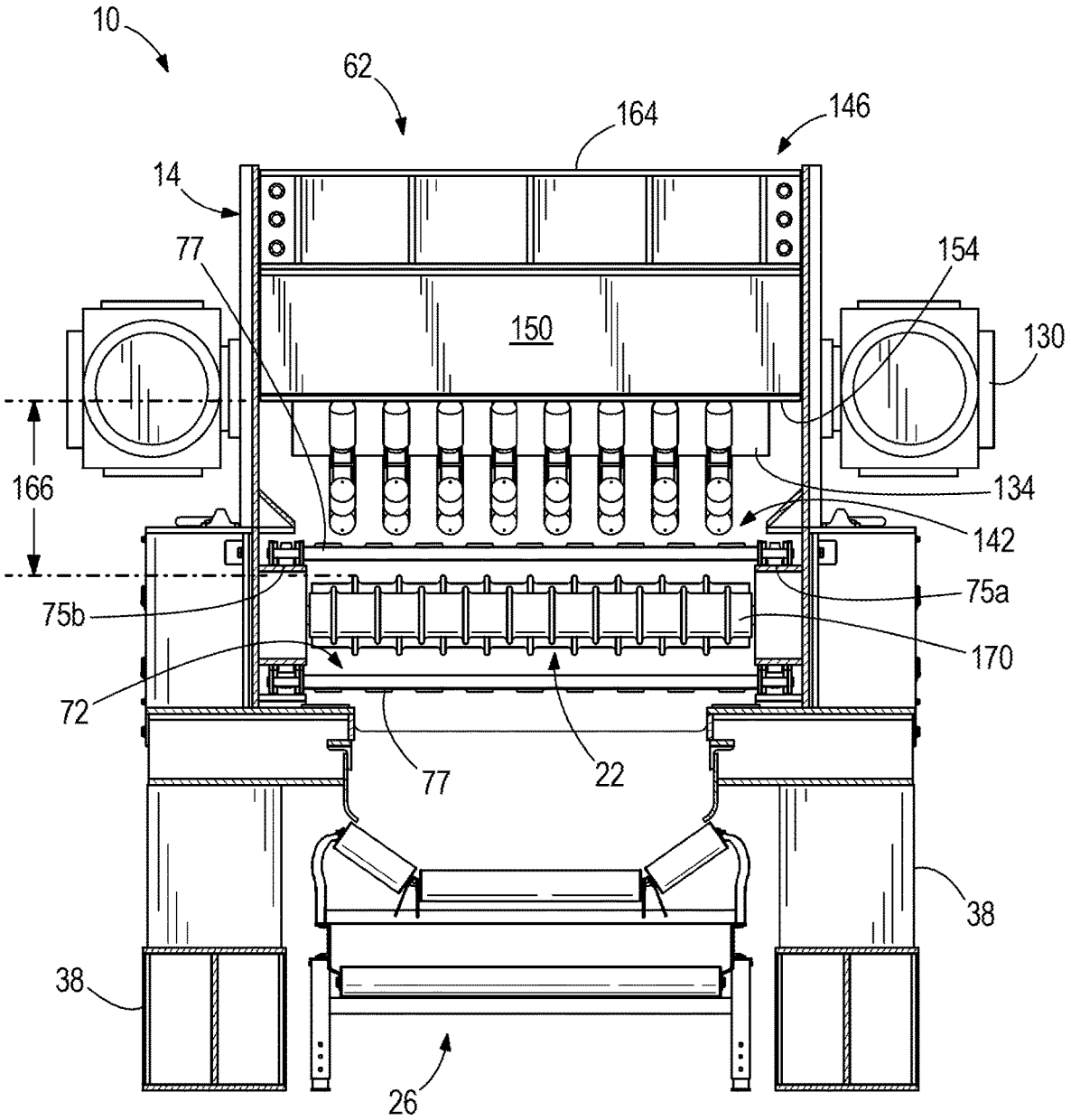
FIG. 11 is a cross-sectional view of the feeder breaker of FIG. 1, taken along lines 11-11 shown in of FIG. 1.

With reference to FIGS. 1 and 10 the output conveying assembly 26 includes an output conveyor 102 and an integrated tailpiece 106 that supports and advances the output conveyor 102 (e.g., a continuous conveyor system).

Figure 2:
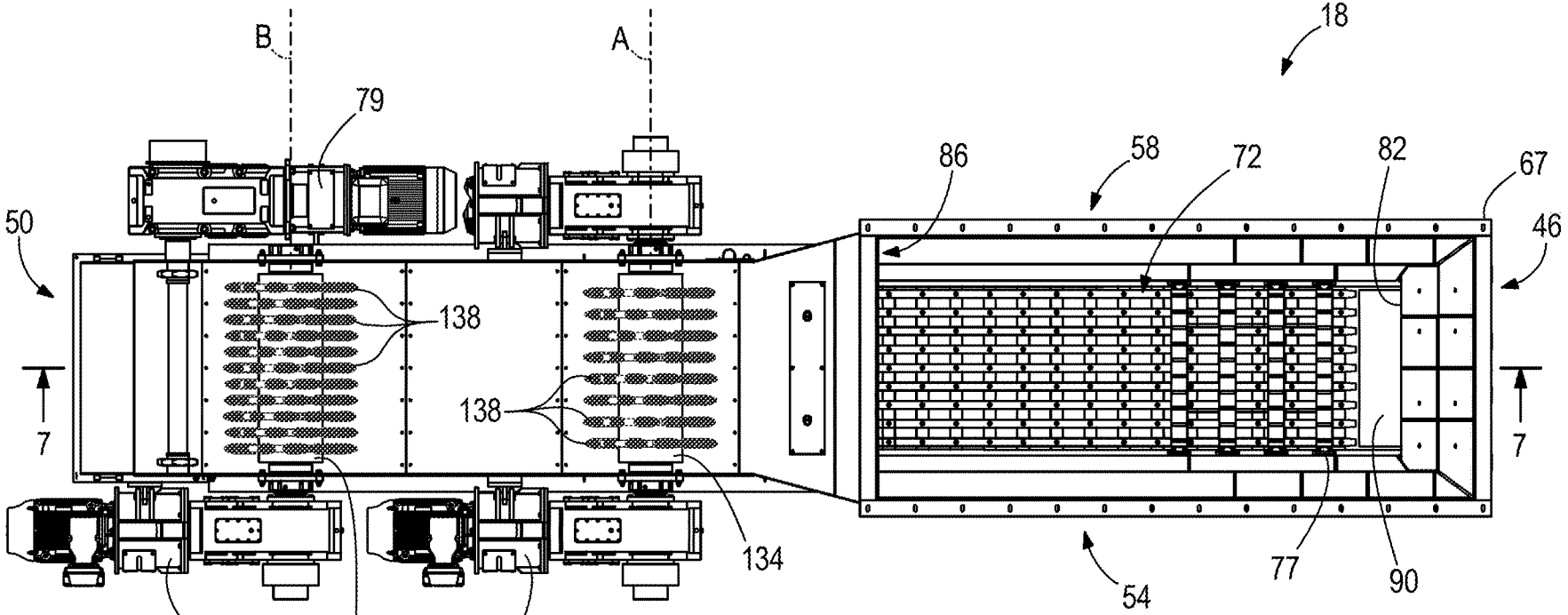
FIG. 2 is a top view of the feeder breaker of FIG. 1 with partial cross-sectional views shown.
Figure 3:
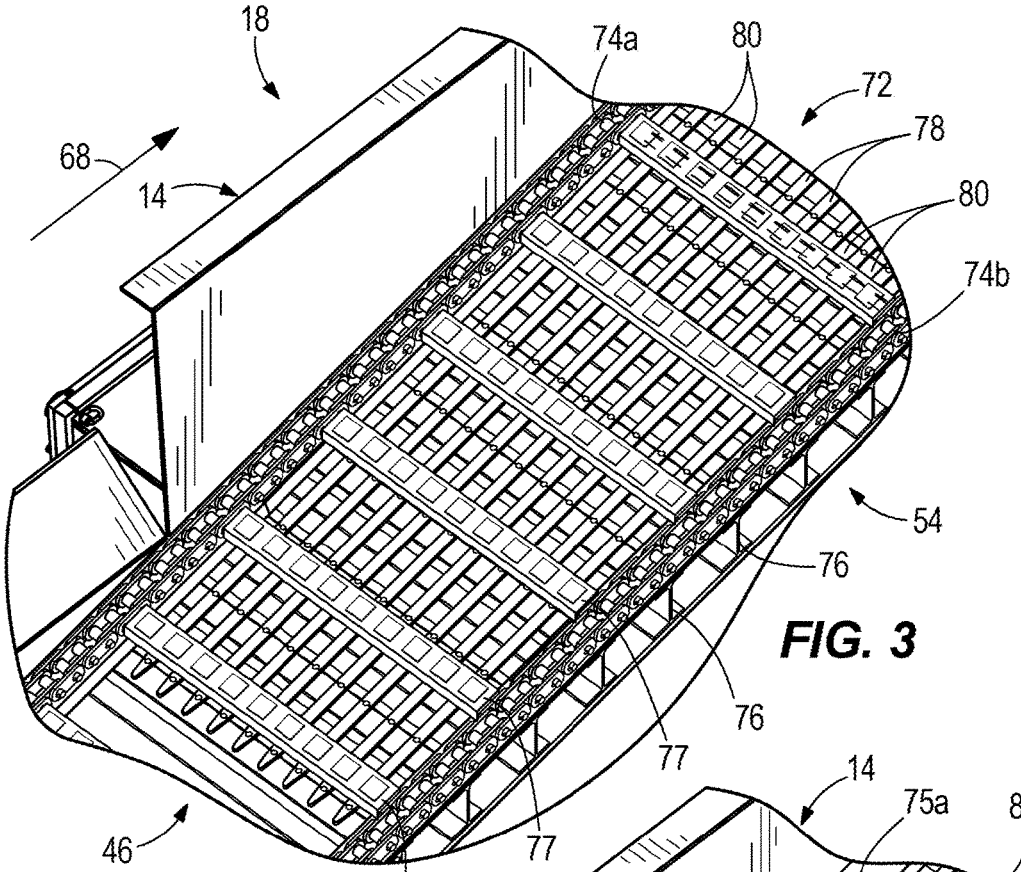
FIG. 3 is a partial perspective view of the feeder breaker of FIG. 1, illustrating an inlet conveying section.
Figure 6:
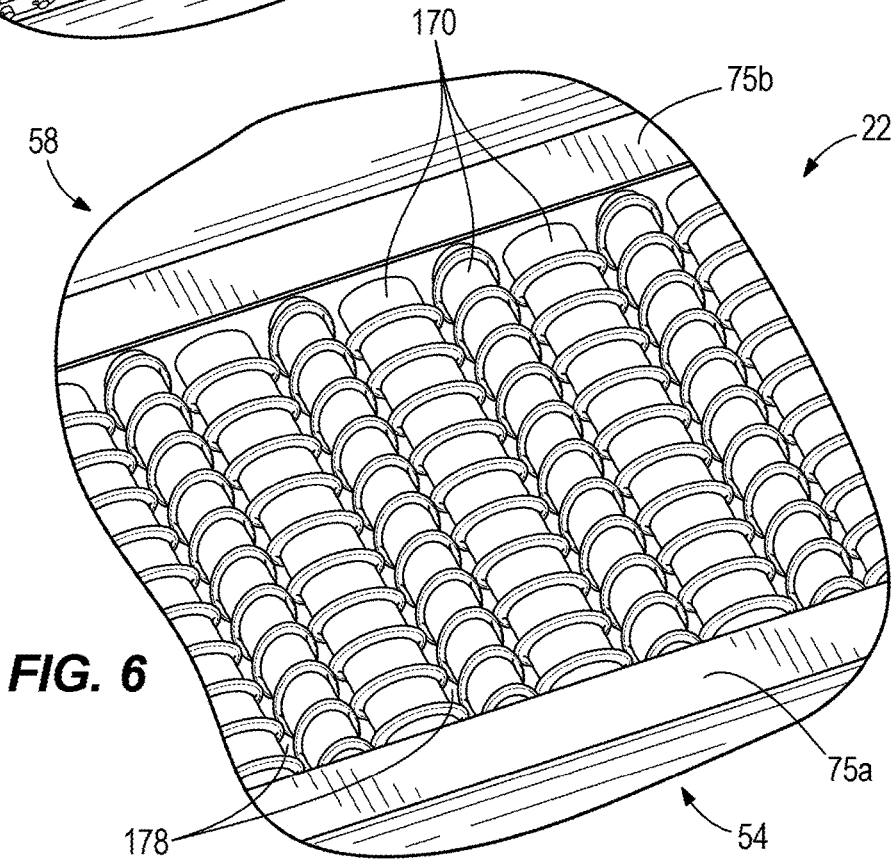
FIG. 6 is a partial perspective view of FIG. 5, with components removed for clarity.
Figure 7:
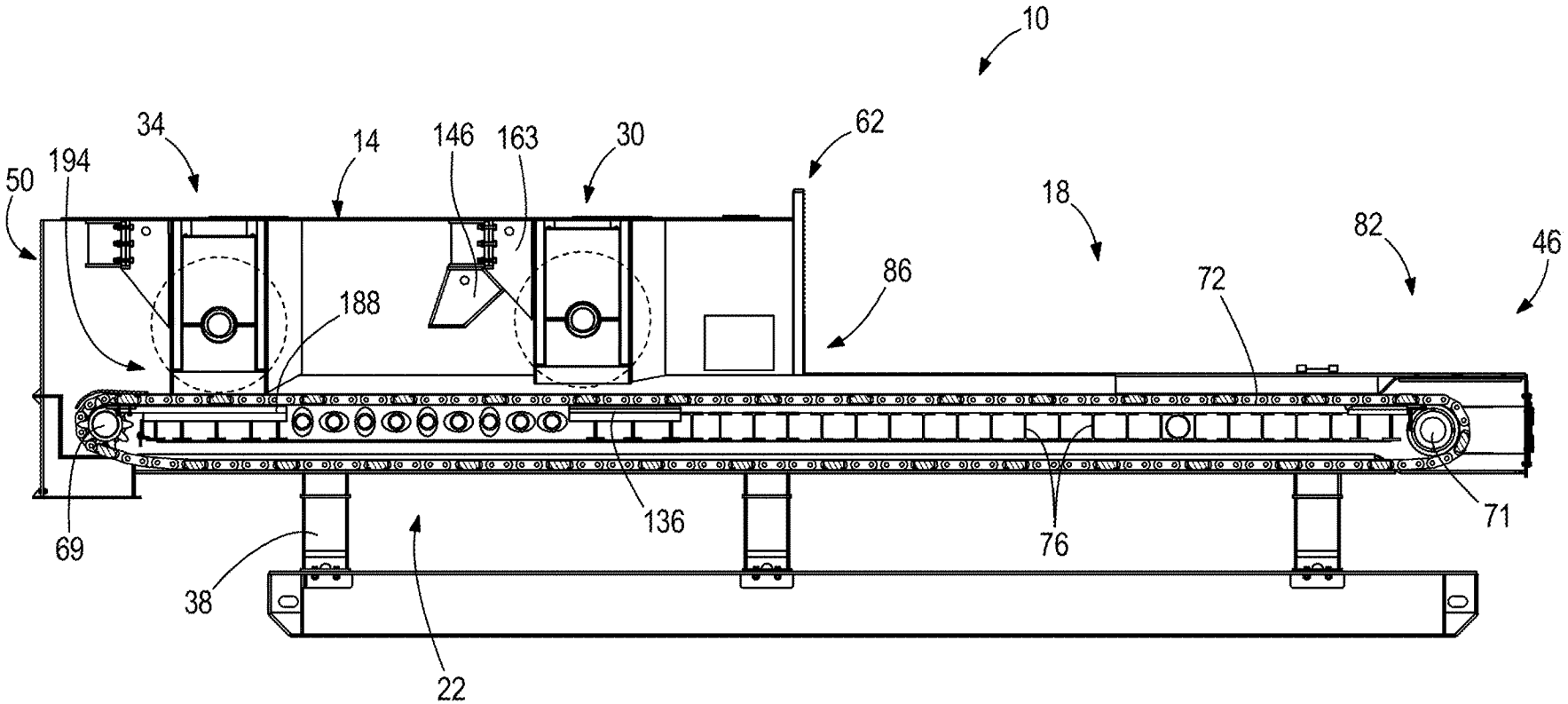
FIG. 7 is a cross sectional side view of the conveyor assembly of FIG. 2, taken along lines 7-7.
Figure 8:
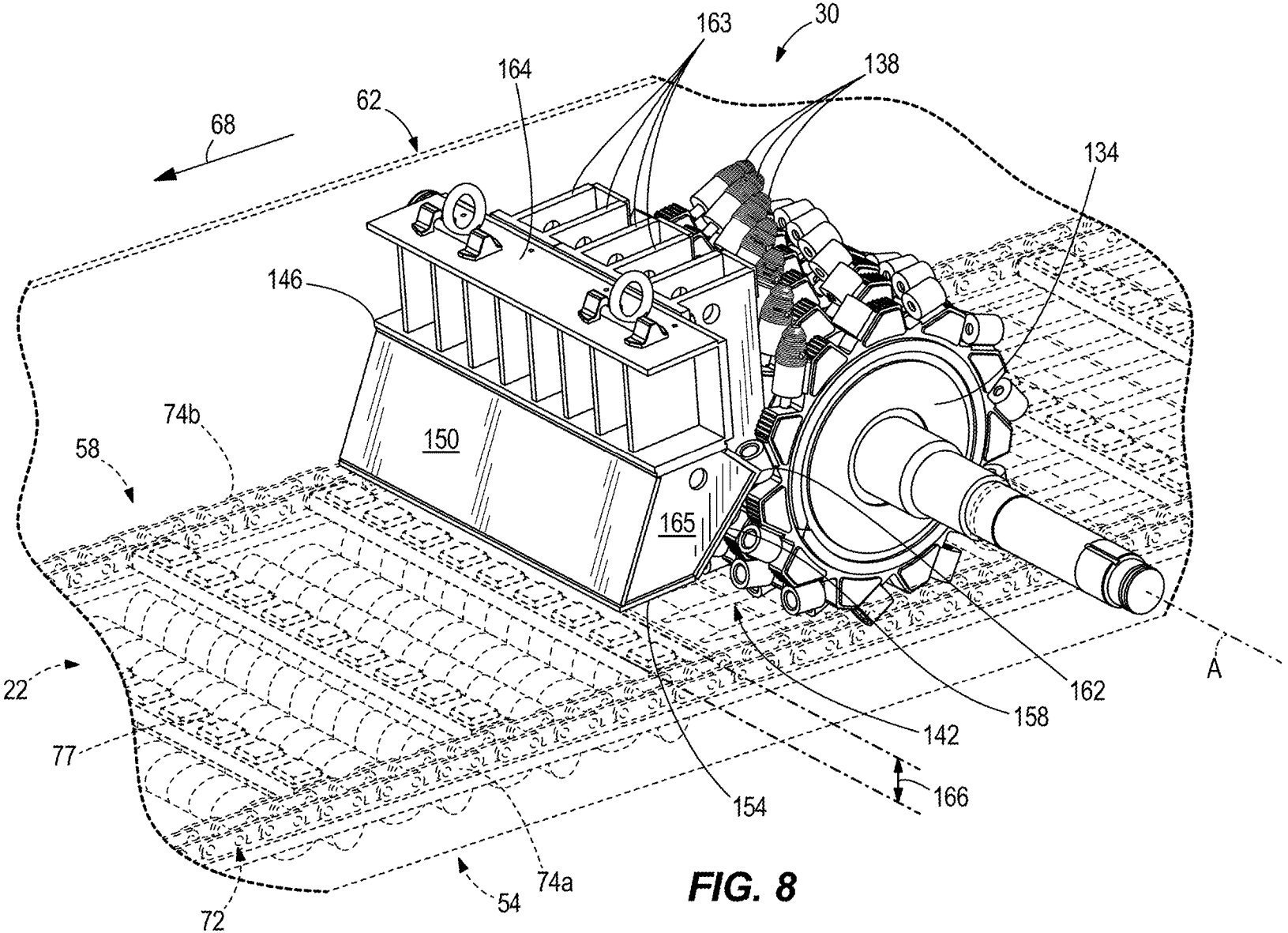
FIG. 8 is a partial perspective view of the feeder breaker of FIG. 1, illustrating a flow limiting member.

With reference to FIGS. 2 and 6, the first crusher 30 is operable to reduce the size of material by a drive 130 rotating a crusher drum 134 about a rotational axis A, in a clockwise direction as viewed from FIG. 6. The crusher drum 134 and drive 130 are supported on the frame 14 of the feeder breaker 10, with the crusher drum 134 extending between the first lateral side 54 and the second lateral side 58 of the frame 14. A first anvil 136 is positioned under the first crusher drum 134 adjacent and downstream from the plurality of slats 78 in the material flow direction 68. The first anvil 136 provides support for material passed under the first crusher. The crusher drum 34 includes a plurality of bits 138 (e.g., carbide bits) to directly contact and fracture material supported on the first anvil 136. Material passes through the first crusher 30 and onto the screening conveying section 22 through an outlet 142 (FIG. 6). In the illustrated embodiment, material is passed under the first crusher 30 to be fractured. In the illustrated embodiment, the first crusher 30 has a sizing ratio range between approximately 2:1 and approximately 10:1. In some embodiments the sizing ratio of the first crusher 30 is 6:1. In other words, the first crusher 30 fractures material that passes through it to one sixth the original size of the material. In other embodiments, the first crusher 30 could be configured to have a different sizing ratio.

With reference to FIGS. 8-11, a flow limiting member 146 (e.g., flow limiting dam) is coupled to the top side 62 of the frame 14 and extends from the first lateral side 54 to the second lateral side 58 of the frame 14. In the illustrated embodiment, the flow limiting dam 146 is adjacent and downstream from the outlet 142 of the first crusher 30. As described in greater detail below, the dam 146 limits the volumetric flow rate of material that is conveyed from the first crusher 30 to the screening conveying section 22 and limits the maximum height of the flow of material. In the illustrated embodiment, the dam 146 has a polygonal cross section and includes a back plate 150, a bottom plate 154, and a front plate 158 having a forward edge 162. The dam 146 is mounted to the frame 14 of the feeder breaker 10 by an upper mount 164, a first side mount 165, and a second side mount 167. The upper mount 164 mounts the dam 146 to the top side 62 of the frame 14, the first side mount 165 mounts the dam 146 to the first lateral side 54 of the frame 14, and the second side mount, mounts the dam 146 to the second lateral side 58 of the frame 14. Attached to the upper mount 164 of the dam 146, are crusher drum cleaning plates 163. The cleaning plates 163 are positioned in between columns of bits 138 on the first crusher 30 to scrape off mine material that collects between the columns of bits 128, which if not removed reduces the efficiency of the first crusher 30. Each cleaning plate 163 protrudes from a front surface 169 of the upper mount and extends from the top side 62 of the frame 14 over the front plate 158 and proceeds pass the forward edge 162. In the illustrated embodiment, there are six cleaning plates 163. In other embodiments, there can be any number of cleaning plates 163.

Material is transferred from the first crusher 30, to the outlet 142 and onto the screening conveying section 22, where the material flow is limited by the dam 146. A clearance 166 (FIG. 9) is defined between the screening conveying section 22 and the bottom plate 154 of the dam 146 to allow a predetermined height of material flow to pass through the dam 146 and continue onto the second crusher 34. By limiting the height of the material flow, the dam 146 also controls the volumetric flow rate of material. The clearance 166 is adjustable and can be changed by adjusting the position of the bottom plate 154 of the dam 146 with respect to the screening conveying section 22. Material that exceeds the clearance 166 abuts the front plate 158 of the dam 146 until the previously passed material is transferred away from the dam 146, along the screening conveying section 22 to the second crusher 34. Material moving downstream of the dam 146 allows room for material upstream of the dam 146 to pass through the clearance 166 towards the second crusher 34. In alternative embodiments, the flow limiting member is, for example, a gate with vertical bars or horizontal columns or other suitable structure for limiting the flow of material. In further alternative embodiments, the feeder breaker 10 includes a second flow limiting member positioned in the material flow path (e.g., upstream of the first crusher 30 in the material flow direction 68).

Figure 5:
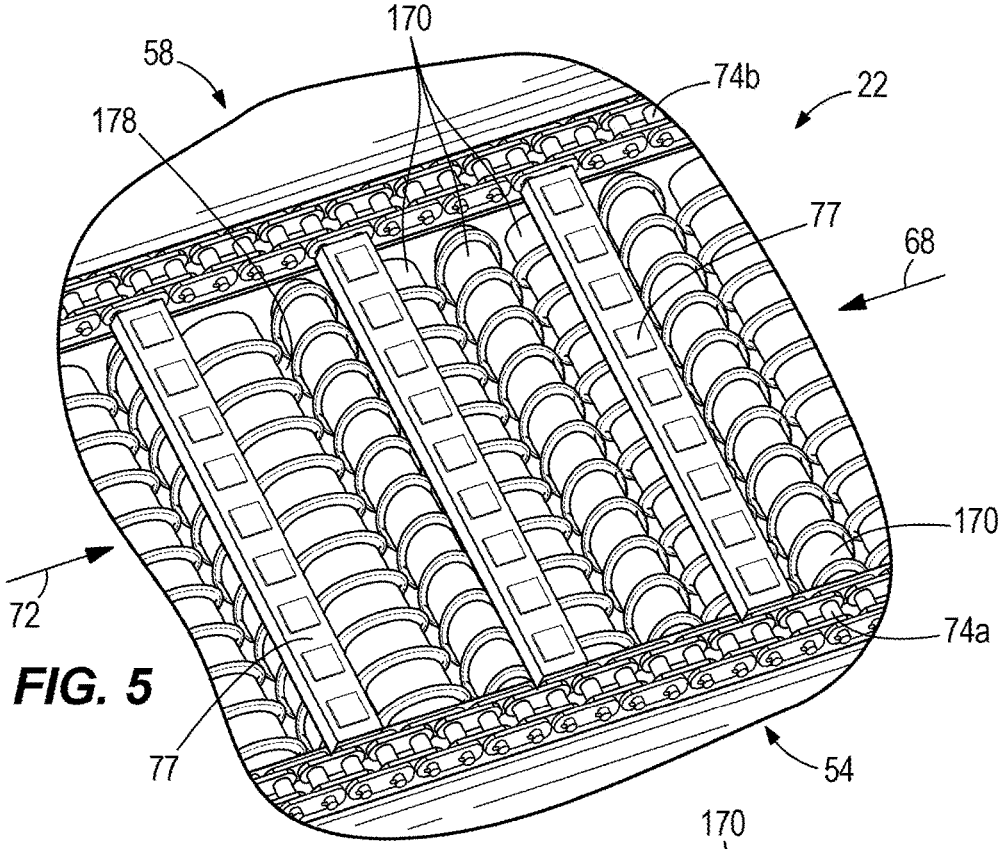
FIG. 5 is a partial perspective view of the feeder breaker of FIG. 1, illustrating a screening conveying section.

With reference to FIGS. 5 and 6, the screening conveying section 22 extends between the first crusher 30 and the second crusher 34, and is configured to screen undersized material that passes from the outlet 142 of the first crusher 30 to the second crusher 34. The screening conveying section 22 includes the conveyor 72 and a plurality of rotating elliptical shafts 170. The rotating elliptical shafts 170 are attached to the frame 14, and extend from the first lateral side 54 of the frame 14 to the second lateral side 58 of the frame 14 (i.e., a wobbler deck). Similar to the slats 78 and openings 80 of the conveyor 72, material is also screened through the screening conveying section 22 via the plurality of rotating elliptical shafts 170.

With continued reference to FIGS. 5 and 6, the elliptical shafts 170 are positioned below the chains 74*a*, 74*b*, similar to the beams 76, within the continuous loop of the conveyor. In this embodiment, the elliptical shafts 170 extend a length 174 (FIG. 1) between the first crusher 30 and the second crusher 34 of the screening conveying section 22 in the material flow direction 68. In other embodiments, the elliptical shafts 170 extend for at least a portion of the length 174 between the first crusher 30 and the second crusher 34. The rotating elliptical shafts 170 are driven by the motor 79 to rotate the shafts 170 the same direction, directing material onto the output conveyor assembly 26. Each elliptical shaft 170 is rotationally offset from an adjacent elliptical shaft 170 by 90 degrees in order to create a gap 178 between two adjacent elliptical shafts 170. In the illustrated embodiment, the gap 178 of the elliptical shafts 170 allows materials between approximately 0 millimeters and approximately 100 millimeters to pass through and onto the output conveyor 102. In some embodiments, the gap 178 is in a range from approximately 50 millimeters to approximately 150 millimeters.

The gaps 178 allow material below a second predetermined size (i.e., the gap size) to pass through the gaps 178 and onto the output conveyor 102 while the screening conveyor section 22 transfers material above a second predetermined size to the second crusher 34. In some embodiments, the second predetermined size is equal to the first predetermined size. In other words, the screening conveying section 22 moves material exiting the first crusher 30 downstream in the material flow direction 68 and removes material below the second predetermined size from the crushing flow of material (i.e., the main flow of material from the input conveying section 18 through the first crusher 30 and through the second crusher 34). In this way, the amount of material that is already appropriately sized is limited from passing through the second crusher 34, which avoids generating additional unwanted fines.

With reference to FIGS. 1 and 2, the second crusher 34 operates much in the same way as the first crusher 30. The second crusher 34 is operable to reduce the size of material received after the screening conveying section 22. Specifically, the second crusher 34 includes a drive 182 that rotates a crusher drum 186 about a rotational axis B, in a clockwise direction as viewed from FIG. 1. A second anvil 188 is positioned under the second crusher 34 crusher drum 134 adjacent and downstream from the elliptical shafts 178 in the material flow direction 68. The second anvil 188 provides support for material passed under the first crusher. The crusher drum 186 has a plurality of bits 138 that directly contact and fracture material supported on the second anvil 188 that passes the crusher drum 186. Material that passes the second crusher 34 exits through an outlet 194 (FIG. 1) of the second crusher 34 to pass over the discharge end 50 of the frame 14 and onto the output conveying assembly 26. In the illustrated embodiment, the second crusher 34 has a sizing ratio within a range of approximately 3:2 and approximately 4:1. In some embodiments the sizing ratio of the second crusher 34 is approximately 2:1. In other words, material that passes through the second crusher 34 is reduced in size by one half.

In operation, the input conveying section 18, the screening conveying section 22, the output conveyor assembly 26, the first crusher 30, and the second crusher 34 operate to minimize the generation of fines (i.e., material small enough that it is generally considered waste). Fines, for example, are generally defined as material less than 6 mm in diameter in many underground mining applications. Fines are more likely to be created when material of appropriate size passes through a crusher, reducing the size of the already appropriately-sized material.

Material is initially received (e.g., dumped) into the input conveying section 18 and collected within the hopper 67. As the chains 74*a*, 74*b* continuously move along the conveyor wear strips 75*a*, 75*b*, the flights 77 push material received in the hopper 67 towards the first crusher 30. When the material passes over the slats 78 and the openings 80, the flights 77 continue to push material larger than the first predetermined size over the openings 80 with at least a portion of the material smaller than the first predetermine size falling through the openings 80 and onto the output conveyor 102 positioned below. Stated another way, material is moved along the conveyor 72 by the flights 77 and at least a portion of the material below the first predetermined size falls through the openings without further traveling towards the first crusher 30. Material larger than the openings 80 pass over the slats 78 and openings 80 and is fed into the first crusher 30 to be reduced before continuing onto the screening conveying section 22. In this way, the fines generated by the first crusher 30 are reduced since at least a portion of the material already below the first predetermined size does not pass through the first crusher 30. Allowing material already below the first predetermined size to pass through the openings 80, avoids passing correctly sized and/or undersized material through the first crusher 30, which creates more undersized material and fines (i.e., waste material).

Figure 9:
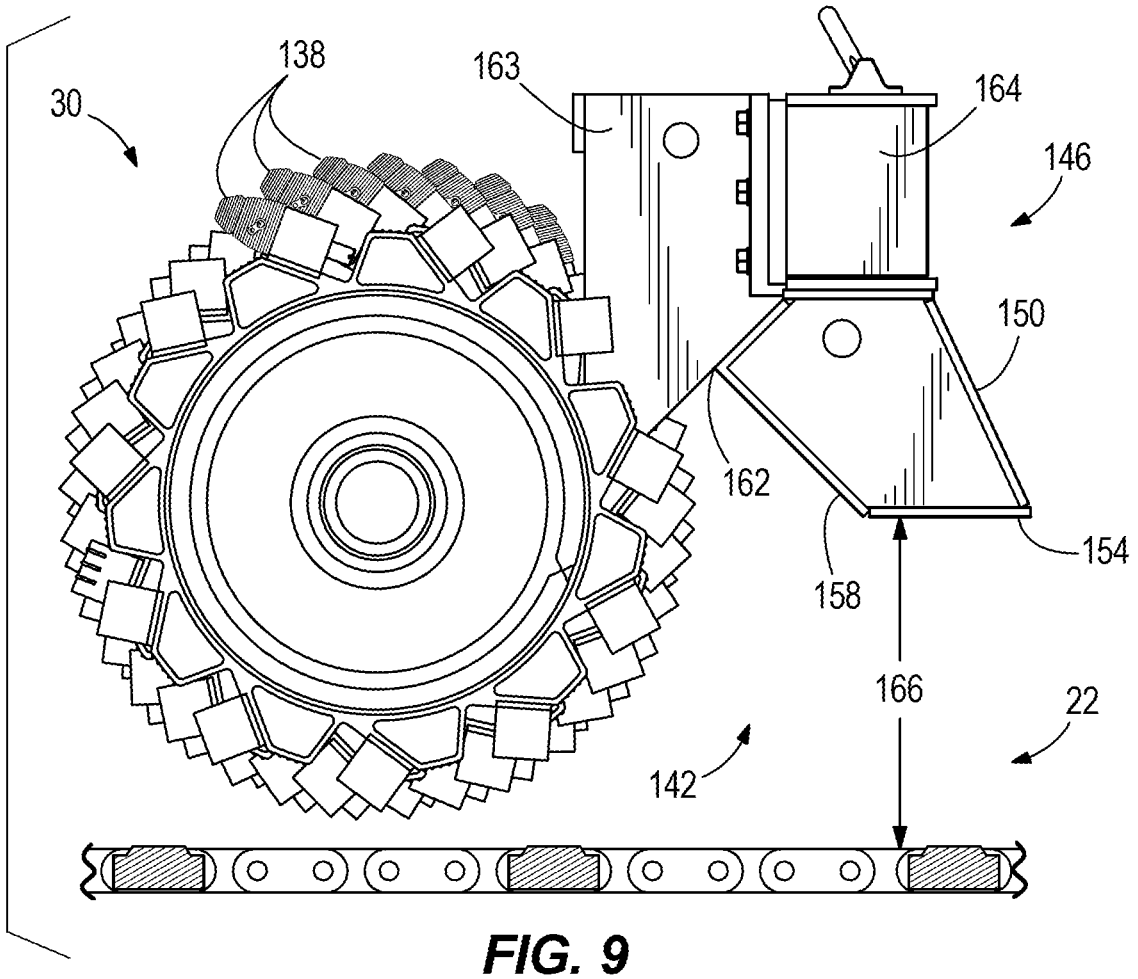
FIG. 9 is a side view of the flow limiting member of FIG. 6.

With reference to FIGS. 1 and 9, operation continues with material exiting the outlet 142 of the first crusher 30 where the material is received by the screening conveying section 22. The dam 146 impedes the flow of material on the screening conveying section 22 to limit the amount of material that flows downstream of the dam 146. Specifically, the forward edge 162 of the front plate 158 of the dam 146 funnels material downward along the front plate 158 toward the bottom plate 154 of the dam 146 (and toward the screening conveying section 22) and, material will pass under the dam 146 through the clearance 166 until the material flow height exceeds the clearance 166. The excess material is blocked by the dam 146 to control the flow of material, until there is enough room for the excess material to be funneled under the dam 146 and through the clearance 166. In addition to the flights 77 of the conveyor 72, the plurality of elliptical shafts 170 helps pass the material through the screening conveyor section 22. The plurality of elliptical shafts 170 of the screening conveying section 22 rotate in a counter-clockwise direction as material is conveyed from one elliptical shaft 170 to a downstream elliptical shaft 170. Due to the elliptical shafts 170 being rotationally offset by 90 degrees, material will be sifted as the flights 77 move material through the screening conveying section 22. When material passes over elliptical shafts 170 with the long ends perpendicular to the material flow direction 68, the material will experience an upward push. When materials passes over an elliptical shaft with its long end parallel to the material flow direction 68, material will experience a drop. The continual push and drop will sift the material as it passes over adjacent elliptical shafts 170 allowing material under the second predetermined size to fall through the gaps 178 and material over the second predetermined size to continue onto the second crusher. Stated another way, material is moved along the screening conveying section 22 by the rotating elliptical shafts 170 and the conveyor 72 and at least a portion of the material that is below the second predetermined size after passing the first crusher 30 falls through the gaps 178 between the shafts 170 and onto the output conveyor 102 without further travelling towards the second crusher 34. The material larger than the gaps 178 is transferred on the screening conveying section 22 to pass through the second crusher 34. The second crusher 34 reduces the size of material even further and exits the material through the outlet portion 192 of the second crusher 34. Material exiting the second crusher 34 is then transferred over the discharge end 50 of the frame 14 and onto the output conveyor 102 where it is joined with material that has previously fallen on the output conveying assembly 26 through either the openings 80 or the gaps 178 of the screening conveying section 22. In other words, the output conveyor 102 is configured to receive the material exiting the second crusher 34.

The first crusher 30, the second crusher 34, the input conveying section 18, and the screening conveying section 22 are controlled by a controller (not shown) specifically to reduce the generation of fines. In particular, the chains 74*a*, 74*b* are rotationally driven by the headshaft 69 and the motor 79 to create a variable material feed rate entering the first crusher 30. Similarly, the elliptical shafts 170 are controlled by the motor 79 to create a variable material feed rate entering the second crusher 34. In addition, the crusher drums 134, 186 are controlled at variable speeds by the drive 130, 182 (i.e., variable speed breaker drums). In order to minimize wear and to reduce fines generation, the rotational velocity of the crusher drums 134, 186 is controlled to suit the velocity of the material passing through the crushers 30, 34. In other words, by varying the speed of the input conveying section 18 and the crusher drums 134, 186, fines generation is minimized.

The feeder breaker 10 with the first crusher 30, the second crusher 34, the input conveying section 18, the screening conveying section 22, and the output conveying assembly 26 allows for at least a portion of the material under the first predetermined size not to pass through the first crusher 30 and allows for at least a portion of the material under the second predetermined size not to pass through the second crusher 34, advantageously minimizing the generation of fines. In other words, the amount of waste material generated by the feeder breaker 10 is reduced. Additionally, the feeder breaker 10 is advantageous in providing an overall crushing ratio range of approximately 10:1 to approximately 14:1. In some embodiments the crushing ratio is 12:1. The large overall crushing ratio allows for large material to be quickly and efficiently reduced to a desired size. Material normally too big for crushing in a single industrial machine can now be reduced in size by going through the feeder breaker 10, with reduced additional fines.

Figure 12:
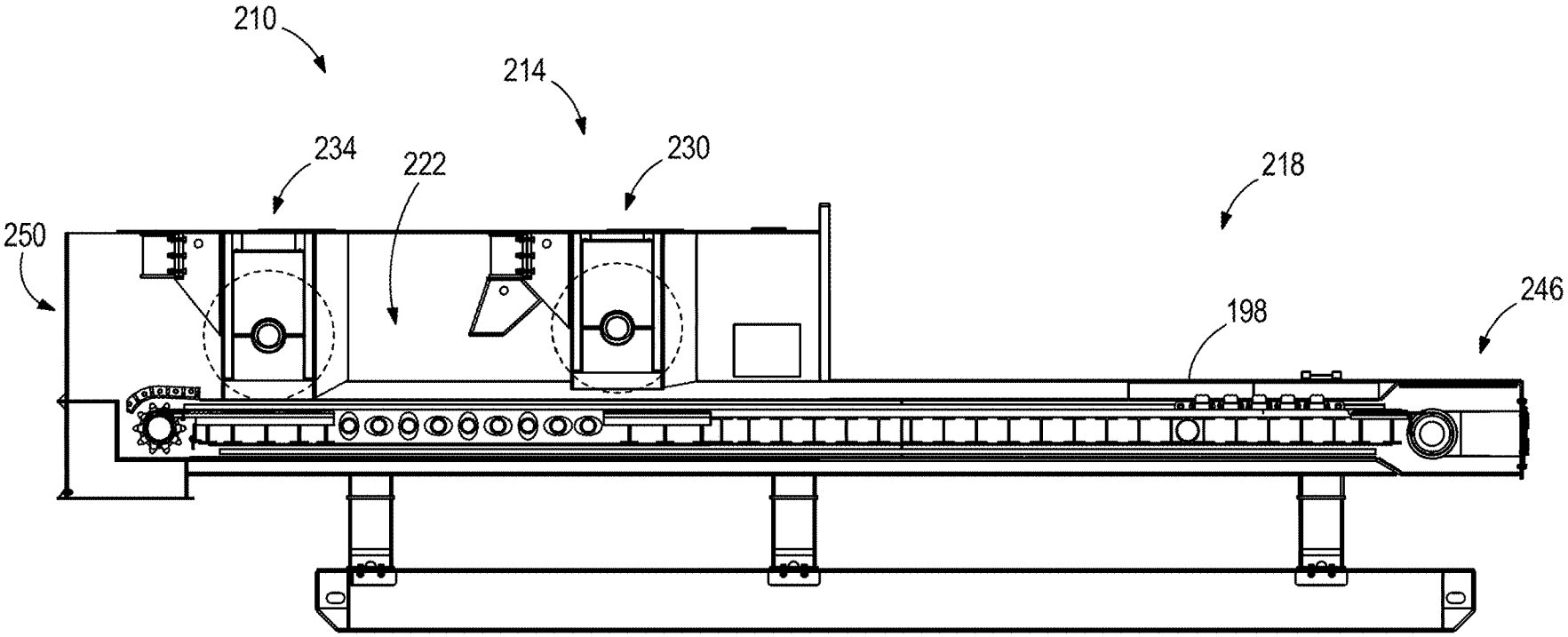
FIG. 12 is a side cross-sectional view of a feeder breaker with partial cross-section views according to another embodiment of the invention.

With reference to FIG. 12, a feeder breaker 210 is illustrated according to another embodiment of the invention. The feeder breaker 210 differs from the feeder breaker 10 in that the feeder breaker 210 does not include a hopper (similar to the hopper 67), but instead includes a flat input conveyor 198 that brings material from a first end 246 of a frame 214 to a first crusher 230.

The feeder breaker 10 may also include a feeder portion coupled to the intake end 46 of the frame 14. In other embodiments, the input conveying section 18 and the screening conveying section 22 may be interchangeable with each other. In further embodiments, the frame 14 may only have one continuous conveying assembly that transports materials from the intake end 46 to the discharge end 50. This continuous conveying assembly may include features of the input conveying section 18 and/or the screening conveying section 22. Additionally, the output conveyor 102 may be a belt conveyor or any other type of conveyor.

Various features and advantages of the invention are set forth in the following claims.

What is claimed is:

1. A feeder breaker comprising:

a frame;

a first crusher coupled to the frame and configured to receive a material;

a second crusher coupled to the frame;

a conveyor extending between the first crusher and the second crusher, the conveyor configured to convey the material exiting the first crusher to the second crusher; and an output conveyor configured to receive the material exiting the second crusher;

wherein at least a portion of the material exiting the first crusher that is below a predetermined size threshold moves to the output conveyor without passing through the second crusher, and wherein the output conveyor is positioned underneath the second crusher.

2. The feeder breaker of claim 1, further comprising a flow-limiting member positioned between the first crusher and the second crusher, wherein the flow-limiting member is configured to limit a flow of the material to the second crusher to below a flow threshold.

3. The feeder breaker of claim 2, wherein the flow-limiting member is a dam coupled to the frame.

4. The feeder breaker of claim 3, wherein the dam is coupled to the frame above a portion of the conveyor and at an outlet of the first crusher.

5. The feeder breaker of claim 2, wherein the flow-limiting member further directs the material toward the conveyor.

6. The feeder breaker of claim 1, further comprising a feeder coupled to the frame and configured to receive the material at a material inlet, and wherein an inlet conveyor extends between the material inlet and the first crusher.

7. The feeder breaker of claim 6, wherein the conveyor includes slats through which some of the material that is below a second predetermined size threshold moves to the output conveyor without passing through the first crusher.

8. The feeder breaker of claim 7, wherein the output conveyor is positioned underneath the slats, the first crusher, and the conveyor.

9. The feeder breaker of claim 1, wherein the conveyor includes a plurality of rotating shafts with a clearance between adjacent rotating shafts.

10. The feeder breaker of claim 9, wherein the plurality of rotating shafts are eccentrically-shaped.

11. The feeder breaker of claim 1, wherein the ratio of the size of the material entering the first crusher and the size of the material exiting the second crusher is 12:1.

12. A feeder breaker comprising:

a frame having a first end, a second end opposite the first end, and a material flow direction defined between the first end and the second end;

a conveying assembly coupled to the frame and configured to convey a material in the material flow direction;

a first crusher coupled to the frame and configured to receive the material conveyed by the conveying assembly;

a second crusher coupled to the frame downstream of the first crusher in the material flow direction, the second crusher is configured to receive the material conveyed by the conveying assembly; and a flow-limiting member coupled to the frame downstream of the first crusher in the material flow direction;

wherein the flow-limiting member is configured to limit a flow of the material to the second crusher, and wherein the flow-limiting member is a dam coupled to the frame above a portion of the conveying assembly.

13. The feeder breaker of claim 12, wherein the flow-limiting member further directs the flow of the material toward the conveying assembly.

14. The feeder breaker of claim 12, wherein the flow-limiting member is a first flow-limiting member and the feeder breaker further includes a second flow-limiting member upstream of the first crusher in the material flow direction.

15. The feeder breaker of claim 12, wherein the conveying assembly includes an output conveyor and slats through which at least a portion of the material below a predetermined size passes through a conveyor section to the output conveyor.

16. The feeder breaker of claim 15, wherein the conveyor section is positioned upstream of the first crusher.

17. The feeder breaker of claim 15, wherein the conveyor section is positioned downstream of the first crusher.

18. The feeder breaker of claim 12, wherein the size of the material downstream of the second crusher is at least 12 times smaller than the size of the material upstream of the first crusher.

19. A feeder breaker comprising:

a frame;

a first crusher coupled to the frame, the first crusher including a first drum and a first anvil;

a second crusher coupled to the frame, the second crusher including a second drum and a second anvil; and a conveyor extending between the first crusher and the second crusher, wherein the conveyor is configured to:

(a) convey material through the first crusher, between the first drum and the first anvil, (b) convey the material exiting the first crusher to the second crusher, and (c) convey the material through the second crusher, between the second drum and the second anvil, and wherein at least a portion of the material exiting the first crusher that is below a predetermined size threshold bypasses the second crusher.

* * * * *